United States Patent [19]

Ryan et al.

[11] Patent Number: 4,904,367

[45] Date of Patent: Feb. 27, 1990

[54] REMOVING HAZE FROM DEWAXED HYDROCARBON OIL MIXTURE BOILING IN THE LUBRICATING OIL RANGE

[75] Inventors: Douglas G. Ryan, Rockaway; Donald B. Trust, Denville, both of N.J.

[73] Assignee: Exxon Research and Engineering Company, Florham Park, N.J.

[21] Appl. No.: 102,389

[22] Filed: Sep. 29, 1987

Related U.S. Application Data

[63] Continuation of Ser. No. 787,384, Oct. 15, 1985, abandoned.

[51] Int. Cl.[4] ..... C10G 73/06; B03C 5/00

[52] U.S. Cl. ..... 208/33; 208/38; 204/181.8; 204/308

[58] Field of Search ..... 208/24, 28, 31, 33, 208/35, 37, 30; 204/181.8, 186, 188, 191, 302, 308

[56] References Cited

U.S. PATENT DOCUMENTS

| | | | |
|---|---|---|---|
| 2,031,210 | 2/1930 | Dillon et al. | 204/181.8 |
| 2,042,887 | 6/1936 | Fisher et al. | 204/181.8 |
| 2,054,273 | 9/1936 | Subkow | 204/181.8 |
| 2,109,131 | 2/1938 | Fisher | 204/181.8 |
| 2,268,788 | 1/1942 | Wanner et al. | 208/33 |
| 2,300,283 | 10/1942 | Fisher | 204/181.8 |
| 2,337,385 | 12/1943 | Gross | 208/33 |
| 2,592,490 | 4/1952 | Thompson | 208/38 |
| 3,129,157 | 11/1963 | Hubby . | |
| 3,412,002 | 4/1964 | Loeckenhoff . | |
| 3,489,669 | 1/1970 | Ruhnke . | |
| 3,616,460 | 10/1971 | Watson et al. . | |
| 4,139,441 | 2/1979 | Bose . | |
| 4,255,777 | 3/9181 | Kelly | 361/228 |
| 4,341,617 | 7/1982 | King . | |
| 4,469,582 | 9/1984 | Sublette et al. . | |
| 4,581,112 | 4/1986 | Mintz et al. | 204/188 |

*Primary Examiner*—Glenn Caldarola
*Attorney, Agent, or Firm*—Jay Simon

[57] ABSTRACT

In a lube oil dewaxing plant in which waxy lube oil is firstly conditioned to promote wax crystallization, such as by adding an oil solvent and chilling the resulting admixture, and then filtered in at least one rotary drum filter (213), the filter includes at least one spray header (92') including a plurality of charge injectors (300) which inject charge by field emission into a field which is sprayed from orifices (246) in the underside of the header onto the filter drum (20). The injected charge has the effect of enhancing separation of haze from the lube oil in the rotary drum filter (213). The charge carrier fluid may for example be solvent-diluted waxy oil or oil solvent liquid alone.

18 Claims, 11 Drawing Sheets

REMOVING HAZE FROM DEWAXED HYDROCARBON OIL MIXTURE BOILING IN THE LUBRICATING OIL RANGE

This is a continuation of application Ser. No. 787,384, filed Oct. 15 1985, now abandoned.

BACKGROUND OF THE INVENTION

This invention relates to methods and apparatus for removing haze from hydrocarbon oil mixture boiling in the lubricating oil range. Throughout this specification, it is to be understood that "hydrocarbon oil mixture" and "oil mixture" both mean a hydrocarbon oil mixture boiling in the lubricating oil range. More particularly, the present invention is concerned with enhanced separation of haze from hydrocarbon oil mixture when using a rotary drum filter.

The problems of wax in lubricating oil are very well known in the art. In the distillation of crude oil, a proportion of wax is present in cuts taken in the lubricating oil range. Some of the wax remains dissolved in the oil, whereas other fractions form a haze as the oil fraction ages at ambient temperatures. Wax in itself is in fact a good lubricant but under comparatively low temperatures such as engine cold start conditions, its presence causes the oil to be thick and viscous and as a result the engine may be hard to turn over at sufficient speed during starting. In addition, wax haze or particulate matter can lead to plugging of the engine oil filter. Haze manifests itself as a milky or cloudy appearance in the oil and is often caused by wax or by both wax and tiny water droplets being present in the lubricating oil. Typically a minimum of about 0.1% by volume of wax will cause some lubricating oil to look hazy. Therefore the existence of haze caused by the presence of wax crystals or particles detrimentally affects the performance of lubricating oils.

Techniques have been available for many years which enable dissolved wax to be separated from lubricating oil. A well-known approach is to mix an oil solvent with the lubricating oil, chill the mixture to precipitate wax crystals, and separate the wax from the resulting slurry by settling or filtration. "Oil solvent" as used throughout this specification refers to those solvents which when added to an oil mixture result in a lower viscosity for the solvent-oil mixture than for the oil mixture alone. Viscosity reduction is beneficial for enhancing the settling or filtration processes used to separate the precipitated wax from the solvent/oil. Usually, the oil solvent will have the additional property of having a higher solubility for the oil (hydrocarbon oil mixture) than for the wax at any given temperature, so that during chilling of the solvent oil mixture to preciitate wax, the wax precipitation is enhanced. Liquified hydrocarbon alkanes or alkenes, ketones, toluene or other aliphatics, and light organic chlorides are examples of well known oil solvents. When the wax-laden oil is cooled, then as the temperature of the oil is reduced, different wax fractions start to come out of solution, aided by the oil solvent. Propane is an example of a preferred oil solvent because in addition to its oil solvent properties, it boils or vporizes at typically encountered conditions of temperature and pressure in propane dewaxing processes, and this in turn leads to an autorefrigeration effect which can be used to bring about the desired cooling, at least in part, of the wax-laden oil.

The grown wax particles and crystals are separated from the lubricating oil/oil solvent mixture, following the above described propane pretreatment, by means of a suitable mechanical filter. Rotary drum filters are well-known in the art for this purpose. The lubricating oil/oil solvent mixture is brought into contact wit a filter cloth, extending around the rotary filter drum, in one angular position of the filter and a wax cake is formed on the filter cloth. In another angular position, the wax cake is washed with a solvent to recover oil from the wax cake and in a further angular position of the rotary filter, wax is scraped from the filter cloth by a scraper or "doctor" blade positioned adjacent the periphery of the rotary filter. The thereby-resulting relatively wax-free cloth then rotates further into contact with the wax-laden mixture of oil and solvent again to collect more wax and this process continues. Since the rate of filtration is directly related to the viscosity of the lube oil/oil solvent mixture, which is lower than that of the lube oil alone, the filtration rate is enhanced.

The wax particles need to be grown as large as possible in the oil solvent pretreatment process, in order to achieve the most effective wax separation by the rotary filters. This requires that the temperature of the wax-laden lubricating oil be reduced very gradually (typically around 2° C. per min.). If the temperature were to be reduced more rapidly, much smaller wax crystals would be produced for a given temperature drop. Therefore, the oil solvent pretreatment apparatus has to be specially designed to provide the necessary stringent operating parameters In addition, dewaxing aids are often used to promote the wax crystallization.

After removal of wax in the rotary drum filter the dewaxed lube oil (DWO) and oil solvent admixture are in general processed in a solvent recovery plant which recovers the oil solvent from the admixture, leaving DWO which is accumulated in oil storage tanks. Generally speaking, the DWO will be found on testing to comply with "specification" requirements but occasionally, due for example to fines breakthrough or malfunction in the dewaxing plant, the lube oil in one of the storage tanks may be determined (usually by visual inspection) to be out-of-specification or hazy. "Out-of-specification" lube oil refers to DWO which contains sufficient haze that it does not comply with prespecified "specification" requirements. The present invention seeks, by novel electrical means, to improve the separation of wax in a rotary drum filter, so as to reduce or minimise the occurrence of production of out-of-specifiction DWO by the rotary drum filters of the dewaxing plant.

DESCRIPTION OF THE PRIOR ART

A number of prior U.S. patents, which are of background interest to the present invention, will now be discussed.

Firstly, U.S. Pat. No. 2,151,318 (Dillon et al.) discloses mixing wax bearing oil with a solvent and then chilling the admixture to precipitate wax. The chilled admixture is passed into a separator in which the wax settlings are removed, and the wax-bearing oil, solvent and remaining precipitate mixture are withdrawn from the separator and then subjected to an electrical field in an electrical treater to cause agglomeration of the wax. As a result, the wax is made more readily filterable or centrifuged, for separation from oil-solvent mixture.

U.S. Pat. No. 2,617,763 (Fischer) is concerned with filtration of solids from liquids (e.g. wax from oils) using a filter medium assisted by an electrostatic field. The filter medium comprises a woven fabric-like sheet material of insulated conductor warp threads and non-insulated conductor threads which are charged to opposite polarities to produce the electrostatic field. The filter medium may be installed within certain rotary filters or drum filters.

Reference is also made to U.S. Pat. No. 3,981,789 (Harrison et al.). In Harrison et al., a waxy oil is chilled to precipitate the wax and then the chilled oil is subjected to filtering. An electric field is applied to the oil in the chiller to prevent the wax from adhering to the walls of the chiller Finally, U.S. Pat. No. 4,1904,956 (Seguine) discloses dewaxing vegetable oils by chilling the oils to precipitate the wax and passing the chilled oil through a mass of glass or ceramic beads across which a high gradient electrostatic field is maintained.

SUMMARY OF THE INVENTION

The invention is concerned with a novel use of a rotary drum filter in the removal of haze from a hydrocarbon oil mixture boiling in the lubricating oil range. The filter comprises a filter vat containing a quantity of oil solvent-diluted waxy oil mixture and a rotating drum in the vat on which a wax cake is formed and then scraped from the rotating drum. According to the method of the present invention, free charge which is net unipolar is introduced into a carrier fluid and the charged fluid is directed onto the wax cake (for example by being sprayed or dripped), to promote removal of haze in the rotary drum filter.

The purpose of the carrier fluid is essentially to carry charge from the charge introducing means into the rotary drum filter, which charge then becomes imparted to wax crystals and any ice crystals and other fines in the filter vat, as well as to the wax cake, as will be described in more detail hereinbelow, and this charge results in more effective separation of wax and ice crystals and other fines on the filter drum. Naturally, the carrier fluid should not ordinarily be one which reacts chemically with any of the constituents of the solvent-diluted waxy oil mixture in the rotary drum filter and, if it is dissimilar to any of the constituents of the solvent diluted waxy oil mixture in the filter, it will preferably be a fluid which can be easily recovered from the solvent-diluted dewaxed oil produced by the filter. However, especially conveniently, the charge carrier fluid is the solvent-diluted waxy oil mixture itself or an oil solvent liquid so that no additional fluid is added in the rotary drum filter other than fluids which are to be used in the filtration process itself.

In one way of putting the invention into effect, the solvent-diluted waxy oil mixture is charged and then sprayed or dripped onto the wax cake on the filter drum. Some of the sprayed or dripped charged solvent-diluted waxy oil mixture is drawn under suction directly through the wax cake on the filter drum, while the remainder streams down the wax cake and drips into the filter vat as replenishing solvent-diluted waxy oil mixture, while filtrate is drawn under reduced pressure from the filter vat through a filter cloth extending around the filter drum, leaving wax and other fines behind on the filter cloth, forming the wax cake. In this way, charge is imparted both to the wax cake and to solvent-diluted oil mixture in the filter vat. This charge transfer has the added benefit of assisting wax and ice collection on the wax cake.

In another way of performing the invention, the solvent-diluted waxy oil mixture is introduced directly into the filter vat while charged oil solvent liquid is sprayed or dripped onto the filter cake.

In another embodiment uncharged solvent-diluted waxy oil mixture is sprayed or dripped onto the wax cake, some of the solvent-diluted oil mixture streaming down the wax cake and dripping into the filter vat as replenishing solvent-diluted waxy oil mixture, while charged oil solvent liquid is also sprayed or dripped onto the wax cake in a "lag" position relative to the sprayed or dripped oil solvent-diluted waxy oil mixture, having regard to the sense in which the filter drum rotates. A modification to this embodiment is to spray the uncharged solvent-diluted waxy oil mixture into charged oil solvent liquid being sprayed onto the wax cake so that the former spray is intimately admixed with and entrained by the latter spray.

In each of the embodiments described as above where oil solvent liquid is sprayed or dripped onto the wax cake, that oil solvent liquid could be replaced by a recycled proportion of the solvent-diluted DWO produced by the rotary drum filter.

The oil solvent-diluted waxy oil mixture in the filter vat is preferably pre-chilled to promote wax crystallization. For achieving this result the oil solvent in the waxy oil mixture is preferably an auto-refrigerant liquid (e.g. propane) which is partially vaporised so as to pre-chill the oil solvent-diluted waxy oil mixture. Similarly, the oil solvent liquid alone sprayed or dripped onto the wax cake is preferably pre-chilled and for this purpose may be an auto-refrigerant liquid.

Other ways exist to alter the solubility of the wax in the oil mixture, prior to filtration. To mixture already diluted with an oil solvent liquid can be added a liquid additive which alters the chemical or physical properties of the solvent by chemical reaction between the additive and solvent or, where the additive is a solvent absorber, by the selective absorption of the solvent by the additive. A second example is to utilize the vapor pressure of the oil mixture such as by venting or drawing vacuum to effect temperature reduction. Alternatively, oil solvent vapor in the gas or vapor atmosphere above a body of oil solvent/lube oil can be selectively removed from the atmosphere to bring about wax precipitation, for example using a flash drum.

It is to be noted that wax and lube oil are chemically similar but have differing molecular weights. To facilitate precipitation of dissolved wax, an additive may be used such as a high molecular weight hydrocarbon, containing an amine group.

Preferred oil solvents for separating wax from a hazy hydrocarbon oil mixture include liquid propane or a liquid alkane (e.g. hexane) or alkene whose molecular weight is between 16 and 114, or any other oil solvent whose electrical conductivity is less than about $10^{-8}$ $(ohm \cdot m)^{-1}$. Preferably, the temperature of the hazy DWO is in the range 140° F. to 200° F. before it is mixed with the oil solvent liquid whose temperature is in the range of 60° F. These temerature ranges help to ensure that the oil solvent dissolves thoroughly and readily in the oil mixture.

As for the net unipolar free charge introduction, various electrical techniques are suitable for this purpose but is preferred to introduce the charge at least predominantly by "electron emission", which term will be described in more detail hereinbelow but which indicates that any ionization effects which occur (e.g. corona discharge) are minimal.

The free charge introduction has the effect of causing the fluid medium into which the charge is introduced to act as a medium through which volumetric distribution of the introduced charge takes place, there being a sufficient excess of free charge introduced such that the volumetric charge distribution imparts charge to the wax cake and to the solvent-diluted waxy oil mixture in the filter vat, thereby promoting separation of wax haze from the oil mixture during the filtering. The volumetric charge distribution causes both an electric field to be induced and the haze in dispersed phase form to become charged, and the induced electric field and the charge on the dispersed phase interact to produce an electrical driving force acting on the dispersed phase which enhances the effectiveness of the filtration which takes place in the rotary drum filter.

Free excess charge imparted to the wax cake and to the wax/water-containing, solvent-diluted, oil mixture in the filter vat is positive or negative ions which, initially, are free to move through the carrier fluid. The carrier fluid acts as a medium through which volumetric distribution of the introduced charge occurs, so as to establish the induced electric field. It is stressed that the electric field is the result not of any voltage applied to any external electrodes so as to set up an electric field between those eIectrodes, but rather arises from the total introduced or injected charge distribution in the various charged fluids in the rotary drum filter and on the wax suspension and the wax cake.

The basis for the effective separation that can be achieved when introducing free excess charge mixture is believed by the inventors to be as follows. The first step in the process is the production of an excess (i.e. net unipolar—positive or negative) charge density in the otherwise electrically-neutral carrier fluid, followed by charge being imparted to the solvent-diluted waxy oil mixture in the filter vat. Several techniques are available to produce a transient or steady-excess charge density. Broadly speaking, such methods fall into two general categories, namely: (1) injection of excess charge across the interface or boundary which confines the carrier fluid and (2) volumetric charge introduction techniques into the bulk of the carrier fluid. Examples of the first category include electron beam and high energy particle radiation, photo-emission and charge transport by a moving fluid. Another example is charge injection as taught in U.S. Pat. No. 4,255,777 (Kelly), the contents of which are expressly incorporated herein by reference and which discloses charge injection predominantly or solely by field emission. Electron beam, photoemission and field emission are all examples of electron emission techniques, and each of them involves minimal or no ionization effects. Examples of the second category are photoionization of either or both of the wax suspension and the oil mixture and secondary ionzation by thermalization of high energy particle irradiation of the hazy dewaxed oil mixture. These examples all involve ionic dissociation within the carrier fluid.

It is necessary that there be an excess of free charge in the solvent-diluted oil mixture in the filter trough in the sense of a sufficient abundance that an effective enhancement of wax separation during filtration will occur. Typically, the density of the free electrons would be of the order of $10^{16}$ charges per $m^3$. A lower limit would be about $1\times10^{10}$ charges per $m^3$. A typical preferred range of free charge density is about $1\times10^{13}$ to $1\times10^{19}$ charges per $m^3$ or even higher, for providing effective enhancement of wax filtration.

The introduced charge must be net negative or net positive. However, providing this requirement is met, then it is equally possible to introduce the excess charge using two streams of opposite but unequal levels of charge or alternating net positive and net negative streams for the purposes of wax haze agglomeration prior to collection, in the first case, or multilayer deposition on the wax cake of the rotary filter drum in the second case (e.g., collecting a net negative layer then a net positive layer, and so forth.)

The next step in the electrical charging process is the transference of the major portion of the excess charge to the wax haze. In a preferred way of performing the invention in which a plurality of charge injectors, such as disclosed in the aforesaid U.S. Pat. No. 4,255,777, is used for introducing net unipolar free excess charge into the carrier fluid, the charged stream issues from each charge injector as a continuous stream or spray through a gas or vapor space under a hood enclosing the filter vat of the rotary drum filter. The gas or vapor space is provided to enable the charged carrier fluid to exit each charge injector with high velocity to efficiently sweep out the injected charge and also to eliminate any charge dissipation path back to the charge injector. Such decoupling of the wax cake on the rotating filter drum from each charge injector is important for achieving a high level and high efficiency of charge injection. It is of no particular importance to the effective removal of the wax haze from the DWO whether the charged carrier fluid is sprayed by the charge injector or simply issues as a continuous stream or is dripped onto the filter drum wax cake particularly at relatively high velocity throughputs in the charge injector. However, when the carrier fluid is sprayed, the individual oil droplets are in general separated from one another and this can be important where lower throughput velocities, closer to the drift velocity of the individual charges, are employed.

In the filtration zone (i.e. in the filter trough and on the wax cake), by whatever means the free excess charge is introduced into the carrier fluid, it is assumed that the excess charge density exceeds the background charge density (i.e. the density of bipolar charge carriers which are intrinsic to the solvent-diluted oil mixture and which result in the conductivity of the solvent-diluted oil mixture); then, the induced electric field in the filtration zone caused by the excess charge density will act on the individual charge carriers and drive them to the boundaries of the solvent-diluted hydrocarbon oil mixture. Some of the charge will be intercepted by the wax particles and/or ice crystals (and other fines) originating from the haze to be removed, and the wax particles/ice crystals will thereby become charged. The interaction which then occurs between the charged wax/ice crystals and the induced electric field causes the dispersed wax/ice crystals to migrate towards the boundaries of the oil mixture, the principal boundary being the exposed surface of the wax cake on the rotating filter drum.

Some wax crystal growth can be expected to arise as a result of migrating wax crystals colliding with one another in the solvent-diluted oil mixture and sticking together or agglomerating to form larger wax crystals. This effect occurs predominantly where the mean migration path length for the wax particles is large compared with the mean spacing between the individual wax particles. However, due to the short migration paths involved, most wax particles on average will reach the wax cake without colliding en route with other migrating wax particles, so that wax particle deposition and agglomeration occurs principally on the wax cake. In practice, direct wax particle deposition on the wax cake, or wax particle deposition on the wax cake following agglomeration within the oil mixture, will occur.

It is to be noted that when using a charge injector to introduce the net unipolar free excess charge, it is important that the stream velocity through the charge injector is high enough to transport the charged stream away from the electrode region of the charge injector. Ideally, the stream velocity needs to exceed the drift velocity relative to the carrier fluid of the individual charges induced by the electric field produced by the charge injector electrodes. On the other hand, the charged solvent-diluted waxy oil mixture needs to remain in contact with the wax cake long enough to enable adequate wax haze to be collected and separated from the oil mixture in the rotary drum filter. This generally requires a comparatively long residence time in the rotary drum filter and therefore a much lower velocity throughput in the filter than in the charge injector. A typical value for the throughput velocity in the charge injector might be 1 m/sec whereas the residence time for the charged DWO on the wax cake might typically be 15 sec. By way of example, in another embodiment the internal cross-sectional diameter of the charge injector orifice diameter might be 0.025 cm, so as to provide a high velocity flow in the region where charge injection occurs. These quoted figures are purely exemplary and have no limiting character.

In order further to explain the nature of the preferred way of charging the carrier fluid, it is explained that when operating a charge injector, which comprises a pointed high potential cathode electrode and an adjacent anode electrode plate having a spray orifice therein opposite the tip of the pointed electrode (for example as disclosed in the aforesaid Kelly U.S. patent), at cathode voltages below a threshold voltage (sometimes known as a "corona" or "cut-in" voltage) free electrons are field-emitted into the carrier fluid flowing past the pointed electrode and through the orifice in the anode plate. The flow of carrier fluid sweeps negative free charge downstream from the charge injector while at the same time further free negative charge is field emitted by the cathode and this process takes effect continuously. As the cathode voltage increases (below the threshold voltage), the level of field emission increases.

When the corona threshold is exceeded (but below a breakdown value to be described below), the high potential applied to the cathode produces ionic dissociation in a localised region around the cathode tip. The positive ions in this region or "cloud" are attracted to the surface of the cathode leaving the negative ions which tend to locate themselves more at the downstream side of the cloud. As carrier fluid flows through the anode/cathode arrangement, the cloud, particularly its downstream side, is swept through the anode orifice while simultaneously fresh carrier fluid arriving in the region of the cathode tip itself becomes ionised around the cathode tip. Depending on the flow velocity, some of the negative ions travelling in the vicinity of the anode orifice are attracted into the anode representing a sharp increase in the anode current. The remaining charge, swept downstream, comprises both positive and negative ions but with a predominance of negative ions. However, due to ions of opposite polarity cancelling one another out in the downstream region the net negative charge is significantly reduced as compared with the situation when operating at a voltage just below corona threshold (i.e. with field emission).

As the applied voltage increases further towards the breakdown value, the "cloud" expands towards the anode plate. When the breakdown value is reached, the "cloud" bridges the gap between the cathode and anode and dielectric breakdown occurs. The anode current rises to a large value while the level of net charge in the downstream region falls to substantially zero.

From the foregoing description it will be appreciated that optimum charging exists at a cathode voltage which is just below the "corona" or "cut-in" threshold. The charge injector is then operating predominantly or solely by field emission. It will also be appreciated that charging by a corona discharge technique is less desirable since it results in lower levels of charging and hence reduced separation effectiveness in the rotary drum filter, whilst if the charging takes place at voltages above the breakdown value, such charging has no beneficial effect on the subsequent filtration. It is also pointed out that when operating below the corona threshold voltage there will generally be little or no ionic dissociation within the carrier fluid. Ways of introducing free excess charge accompanied by little or no ionic dissociation within the carrier fluid apart from by field emission, include electron beam and photoemission techniques, as referred to hereinabove. These and other similar techniques in which only minimal ionization effects occur are included in the term "electron emission", as used in this specification.

Throughout the foregoing description reference has been made predominantly to removing the wax haze since the invention is particularly adapted for this purpose. There have, however, been references to producing ice crystals and in this respect it is explained that in general, providing the solvent-diluted lube oil is chilled sufficiently, fine water droplets forming haze in the lube oil will be converted to ice crystals and these will also be collected on the wax cake of the rotary filter drum. Cooling to such a degree will in fact normally be expected to occur since the cooling has to be sufficient to sustain a typical rotary drum filter operating temperature of about −30° F. in propane dewaxing or 0° F. in ketone dewaxing.

According to a preferred way of putting the invention into effect, the carrier fluid is introduced into a spray header and sprayed from a plurality of orifices in the header, the header extending substantially parallel to the axis of the drum of the rotary filter and the orifices being evenly spaced along the length of the header, and free charge that is net unipolar is introduced such as by charge injection (field emission) into the carrier fluid immediately prior to being sprayed through each orifice.

According to another preferred way of performing the invention, there is provided a method of using a rotary drum filter in the removal of haze from a hydrocarbon oil mixture boiling in the lubricating oil range, said filter comprising a filter vat containing a quantity of oil solvent-diluted waxy oil mixture and a rotating drum in the vat, having a filter cloth thereon, wherein, starting from a point on the filter cloth entering the oil solvent-diluted waxy oil mixture in the filter vat, that point is subjected, in successive sectors through which it passes in turn, to the respective steps of:

having suction applied so as to draw filtrate through the filter cloth while forming a wax cake on the filter cloth;

spraying solvent-diluted waxy oil mixture, into which free charge which is net unipolar has been injected by field emission, onto the wax cake;

spraying a conditioning oil solvent liquid onto the wax cake to remove filtrate from the wax cake;

directing blow gas onto the filter cloth to cause it to billow out slightly; and scraping the wax cake from the filter cloth before said point re-enters the oil solvent-diluted waxy oil mixture in the filter vat.

According to a still further way of performing the invention, there is provided a method of using a rotary drum filter in the removal of haze from a hydrocarbon oil mixture boiling in the lubricating oil range, said filter comprising a filter vat containing a quantity of oil solvent-diluted waxy oil mixture and a rotating drum in the vat, having a filter cloth thereon, wherein, starting from a point on the filter cloth entering the oil solvent-diluted waxy oil mixture in the filter vat, that point is subjected in successive sectors through which it passes in turn, to the respective steps of:

having suction applied so as to draw filtrate through the filter cloth and form a wax cake on the filter cloth, while replenishing oil solvent-diluted waxy oil mixture is introduced directly into the filter vat;

spraying an oil solvent liquid, into which free charge which is net unipolar has been injected by field emission, onto the wax cake;

spraying a conditioning oil solvent liquid onto the wax cake to remove filtrate from the wax cake;

directing blow gas onto the filter cloth to cause it to billow out slightly; and scraping the wax cake from the filter cloth before said point re-enters the oil solvent-diluted waxy oil mixture in the filter vat.

According to a third preferred way of performing the invention there is provided a method of using a rotary drum filter in the removal of haze from a hydrocarbon oil mixture boiling in the lubricating oil range, said filter comprising a filter vat containing a quantity of oil solvent-diluted waxy oil mixture and a rotating drum in the vat, having a filter cloth thereon, wherein, starting from a point on the filter cloth entering the oil solvent-diluted waxy oil mixture in the filter vat, that point is subjected, in successive sectors through which it passes in turn, to the respective steps of:

having suction applied so as to draw filtrate through the filter cloth while forming a wax cake on the filter cloth;

spraying solvent-diluted waxy oil mixture onto the wax cake;

spraying an oil solvent liquid, into which free charge which is net unipolar has been injected by field emission, onto the wax cake;

spraying a conditioning oil solvent liquid onto the wax cake to remove filtrate from the wax cake;

directing blow gas onto the filter cloth to cause it to billow out slightly; and scraping the wax cake from the filter cloth before said point re-enters the oil solvent-diluted waxy oil mixture in the filter vat.

Having briefly described the method of this invention, it is pointed out that the invention also finds application to the novel rotary drum filter itself.

According then to a further aspect of the invention, there is provided a rotary drum filter for use in the removal of haze from a hydrocarbon oil mixture boiling in the lubricating oil range, said filter comprising:

a filter vat for containing a quantity of oil solvent-diluted waxy oil mixture;

a rotatable wax collecting drum disposed in said filter vat with part of its wax collecting surface immersed, in use, in said quantity of oil solvent-diluted waxy oil mixture in said vat;

means arranged to rotate said drum continuously;

means for directing a fluid onto the drum surface; and means associated with said fluid directing means, arranged to introduce free charge which is net unipolar into said fluid to be directed onto the drum surface.

Preferably the charge injection device comprises a pointed high potential electrode and a low potential electrode in the form of a plate arranged adjacent to but spaced from the high potential electrode, said electrode plate having an orifice therein opposite the tip of said pointed electrode to provide a flow path for fluid past the tip of said pointed electrode to said orifice in said electrode plate, which orifice comprises the respective spray orifice of the spray header.

According to another aspect of the invention there is provided a plant for removal of haze from hydrocarbon oil mixture boiling in the lubricating oil range, which comprises means for conditioning said oil mixture for promoting crystallization of at least wax in the oil mixture, said conditioning means comprising at least means for adding an oil solvent to the hydrocarbon oil mixture, and filtering means, including a rotary drum filter, for removing at least crystallized wax from the conditioned oil mixture, said rotary drum filter comprising:

a filter vat for containing a quantity of conditioned oil mixture;

a rotatable wax collecting drum disposed in said filter vat and having a filter cloth thereon, part of which is immersed, in use, in said quantity of conditioned oil mixture in said vat;

means arranged to rotate said drum continuously;

means for drawing filtrate through said immersed part of said filter cloth, leaving wax cake on said filter cloth;

header means for spraying conditioned oil mixture from the conditioning means onto the wax cake from a plurality of spray orifices of the header means which are uniformly spaced over substantially the entire length of said header means;

a plurality of charge injectors respectively associated with said spray orifices to inject free excess charge which is net unipolar by field emission into the conditioned oil mixture to be sprayed through said spray orifices, for promoting haze removal in said rotary drum filter; and means for scraping the wax cake from the filter cloth before re-entry thereof into the quantity of conditioned oil mixture in the filter cloth.

According to a further aspect of the invention there is provided a plant for removal of haze from hydrocarbon oil mixture boiling in the lubricating oil range, which comprises means for conditioning said oil mixture for promoting crystallization of at least wax in the oil mixture, said conditioning means comprising means for adding an oil solvent to the hydrocarbon oil mixture, and filtering means, including a rotary drum filter, for removing at least crystallized wax from the conditioned oil mixture, said rotary drum filter comprising:

a filter vat for containing a quantity of conditioned oil mixture, said vat being provided with means for feeding conditioned oil mixture from said conditioning means directly to said vat;

a rotatable wax collecting drum disposed in said filter vat and having a filter cloth thereon, part of which is immersed, in use, in said quantity of conditioned oil mixture in said vat;

means arranged to rotate said drum continuously;

means for drawing filtrate through said immersed part of said filter cloth, leaving wax cake on said filter cloth;

header means for spraying an oil solvent liquid onto the wax cake from a plurality of spray orifices of the header means which are uniformly spaced over substantially the entire length of said header means;

a plurality of charge injectors respectively associated with said spray orifices to inject free excess charge which is net unipolar by field emission into the oil solvent liquid to be sprayed through said spray orifices, for promoting haze removal in said rotary drum filter; and means for scraping the wax cake from the filter cloth before re-entry thereof into the quantity of conditioned oil mixture in the filter vat.

According to yet another aspect of the invention there is provided a plant for removal of haze from hydrocarbon oil mixture boiling in the lubricating oil range, which comprises means for conditioning said oil mixture for promoting crystallization of at least wax in the oil mixture, said conditioning means comprising at least means for adding an oil solvent to the hydrocarbon oil mixture, and filtering means, including a rotary drum filter, for removing at least crystallized wax from the conditioned oil mixture, said rotary drum filter comprising:

a filter vat for containing a quantity of conditioned oil mixture;

a rotatable wax collecting drum disposed in said filter vat and having a filter cloth thereon, part of which is immersed, in use, in said quantity of conditioned oil mixture in said vat;

means arranged to rotate said drum continuously;

means for drawing filtrate through said immersed part of said filter cloth, leaving wax cake on said filter cloth;

first header means for spraying conditioned oil mixture from said conditioning means onto the wax cake on said filter rum from a plurality of spray orifices of the first header means which are uniformly spaced over substantially the entire length of said first header means;

second header means for spraying an oil solvent liquid onto the wax cake from a plurality of spray orifices of the second header means which are uniformly spaced over substantially the entire length of said second header means, said second header means being in a lag position relative to said first header means, having regard to the direction of rotation of the filter drum;

a plurality of charge injectors respectively associated with said spray orifices to inject free excess charge which is net unipolar by field emission into the oil solvent liquid to be sprayed through said spray orifices, for promoting haze removal in said rotary drum filter; and means for scraping the wax cake from the filter cloth before re-entry thereof into the quantity of conditioned oil mixture in the filter vat.

BRIEF DESCRIPTION OF THE DRAWINGS

The invention will be better understood from the following description given by way of example and with reference to the accompanying drawings wherein.

In the drawings, the same reference numerals denote the same or equivalent parts.

DESCRIPTION OF THE PREFERRED EMBODIMENTS

Figure 1:
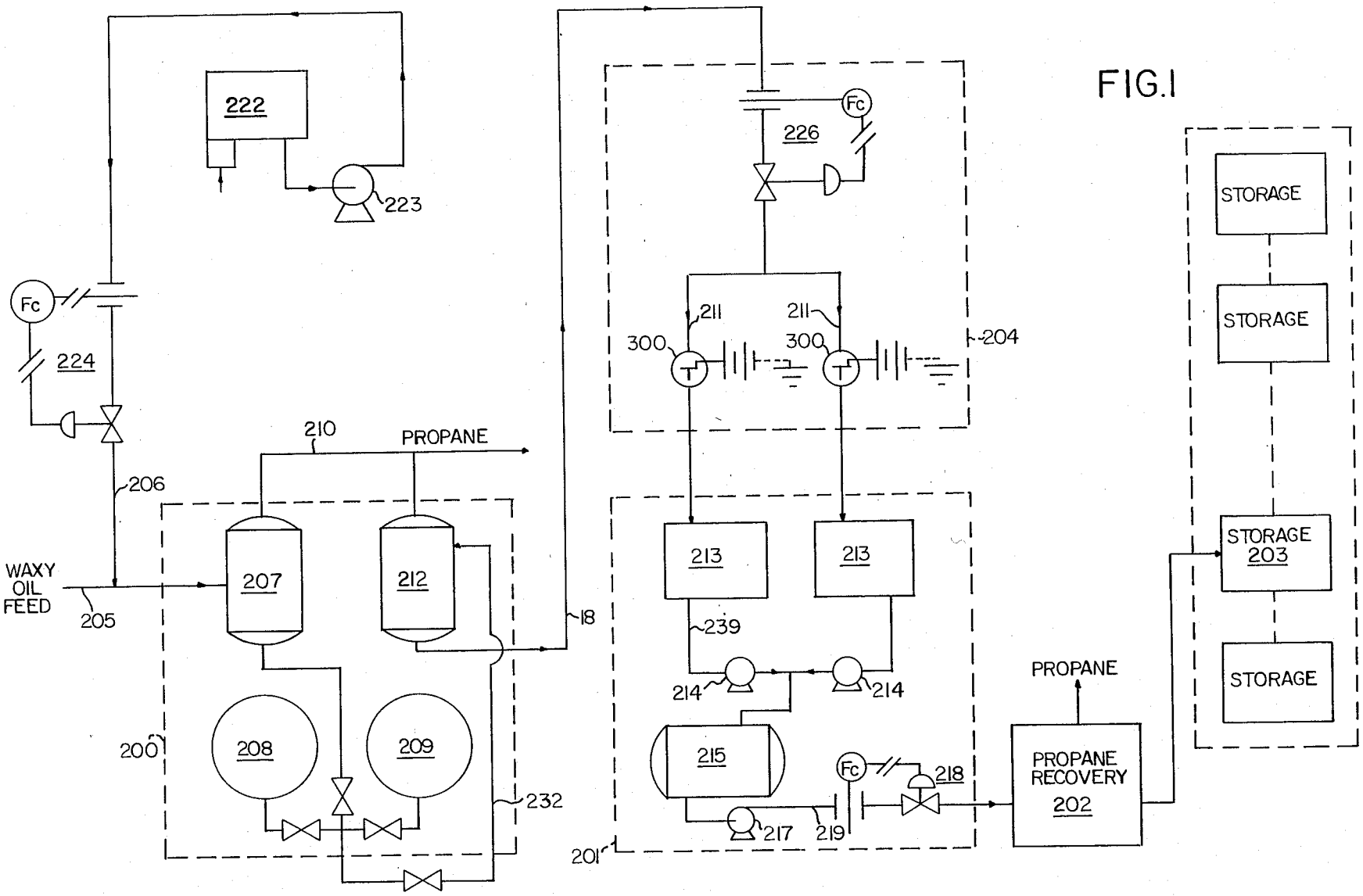
FIG. 1 is a diagram of a lube oil dewaxing plant, forming a first embodiment of the invention, in which charge is injected into hazy lube oil in a spray header of each of two rotary drum filters in the filtration stage of the dewaxing plant.

Referring to the embodiment of FIG. 1, undewaxed hazy lube oil which contains wax in dissolved and/or dispersed form and fine dispersed water droplets is fed to a lube oil dewaxing plant which comprises, essentially, a dilution and chilling stage 200, followed by a charging arrangement 204, a filtration stage 201, a solvent (in this case propane) recovery stage 202, and oil storage means comprising a plurality of storage tanks such as tank 203. In the dilution and chilling stage 200, propane solvent is used to provide favourable conditions for growth of wax crystals and to dilute the resultant chilled slurry so as to permit continuous oil-wax separation using rotary drum filters in the filtration unit 201. One dewaxing solvent which is used industry-wide is propane which is used both as a diluent and as a refrigerant. As an auto-refrigerant, propane is used to chill the originally warm (typically around 80° F.) solution of waxy oil and propane to the necessary filtration temperature (about 40° F. below pour point). This propane auto-refrigeration effect is accomplished by evaporation of propane from the warm waxy oil-propane mixture, for example in a batch chiller in the dilution and chilling stage. Propane is evaporated from the batch over a period of time such that the chilling rate of around 4° F. (2° C.) per minute is achieved. Such a cooling rate is conducive to the growth of large wax crystals with the resultant good filtration properties. As a result of the dilution and chilling which takes place in the dilution and chilling stage, the slurry entering the filtration stage 201 contains wax particles or crystals and ice crystals which are separated from the lube oil and propane solvent by rotary drum filters or separators 213 of the filtration stage. The filtration stage 201 removes wax and ice crystals from the oil slurry feed leaving a mixture of dewaxed oil (DWO) and propane solvent which is then passed to a propane solvent recovery stage 202, which removes the propane solvent to yield dewaxed oil (DWO) which is then fed to oil storage tank 203. As indicated, that oil storage tank is usually sited at the refinery along with a number of other tanks so that when storage tank 203 is full, further DWO from the propane solvent recovery stage can be piped to another oil storage tank.

As described so far, the dewaxing plant is conventional. In such dewaxing plant, it is often found, depending on operating conditions, that the DWO, for example visually inspected in storage tank 203, does not comply with specification requirements. The DWO is out-of-specification because small wax crystals and other fines pass through the filter cloth of each rotary drum filter. In order to reduce fines breakthrough and thereby improve efficiency of wax pick-up on the filter cloth, according to the invention free excess electric charge is introduced into the chilled, propane-diluted waxy oil feed to the rotary drum filters 213 in charging arrangement 204 which is associated with one or more spray headers of each rotary drum filter, which headers spray the chilled, charged, propane-diluted waxy oil onto the filter drum. It is preferred that the free excess electric charge is introduced by charge injection, as described below with particular reference to FIG. 4. As described in more detail in the introductory part of the specification, the effect of the introduced or injected charge is that the fine wax crystals and particles and any ice crystals present become charged and this charge enables them to be filtered more readily in the rotary drum filters 213, thereby obviating or minimising the production of out-of-specification DWO.

Referring now to the details of the dewaxing plant, in FIG. 1 the dilution and chilling stage 200 comprises a batch chiller of essentially known construction. Waxy oil feed at a temperature above its cloud point (e.g. 140®–180° F.) is fed along line 205 into which a measured proportion of liquid propane solvent (typically in the volumetric dilution ratio range of 1 to 3 and at a temperature typically of around 100° F.), determined by flow control valve arrangement 224 and pumped by pump 223 from propane surge drum 222, is introduced along line 206, and the waxy oil/propane mixture is precooled in a precooler (not shown for simplicity) to a temperature (about 80° F.) above the cloud point for the oil/propane mixture (i.e. the temperature at which wax particles start to come out of solution), whereupon it is introduced into a feed drum 207, in which a quantity of propane-diluted waxy oil is stored. From there the propane-diluted waxy oil is fed to a minimum of two batch chillers but for simplicity in the embodiment illustrated, just two batch chillers 208, 209 are used. In embodiments having more than two chillers the chillers are arranged into two groups with the chillers of each group interconnected. In either case a batch of propane/waxy oil can be treated in one batch chiller (or group) while the other one is emptied and refilled and vice-versa, so that in effect the facilities upstream and downstream of the batch chilling can be operated continuously.

Some of the dissolved liquid propane in feed drum 207 vaporises and propane vapor is conveyed away from the feed drum along line 210. Only a small temperature drop normally occurs in feed drum 207 in order that the temperature of the propane/waxy oil entering batch chiller 208 or 209 remains marginally below the cloud point of the oil-solvent mixture.

Each batch chiller 208, 209 is generally spherical in shape. It has already been remarked that alternately one chiller is used to chill a batch of propane-diluted waxy oil, while the other chiller is emptied into drum 212 and then refilled from drum 207. Once admitted to one of the chillers, the mixture is cooled at a controlled rate by continuous evaporation of propane under carefully controlled conditions. The pressure in the chiller filled with warm (80° F.) propane-diluted waxy oil is approximately 10 atmospheres. The propane vapor is conveyed along lines, which have been omitted for simplicity, from the spherical batch chillers 208, 209 to propane line 210 which is maintained at low pressure, e.g. 3–5 psig. Typically, a batch of the mixture of waxy oil and propane is chilled from about 80° F. to the necessary filtration temperature in about 30 minutes to provide a chilling rate of about 4° F. per minute, after which the chilled slurry at a temperature around 40° F. below the required DWO pour point is emptied from batch chiller 208 along line 232 to a filter feed drum 212. Due to the cyclic nature of the batch chilling operations, periodic opening and closing of numerous large motor-operated valves is necessary. Such valves are depicted in FIG. 1 but not referenced since the batch chiller arrangement which has been described above is very well known in the art and need not be described in any further detail herein. As is also well known, various pressure, flow and/or level control arrangements are generally needed in a practical realisation of the batch chiller arrangement but for simplicity are not depicted in FIG. 1 or described.

The chilled slurry flows by gravity from the filter feed drum along a line 18 to charging arrangement 204. In the charging arrangement, a controlled feed of chilled slurry, determined by the setting of a flow control valve arrangement 226 in line 18, is divided into a number of individual feeds, each conveyed along a respective branch line 211 to a spray header or drip pipe (hereinafter referred to as a "spray header") of each rotary drum filter. A minimum of two rotary drum filters 213 is used, but for simplicity only two rotary drum filters are shown in FIG. 1.

The construction of each rotary drum filter 213 will now be described with reference to FIG. 2 in which an exploded, simplified isometric assembly drawing of a typical rotary drum filter is shown. The filter includes a filter vat, generally indicated as 10, and a filter drum generally indicated as 20. Vat 10, having a substantially semicylindrical shape, is supported by columns 12 above base 14. A filter hood 90 having an overall semicylindrical shape has a plurality of perforated spray headers 92, and also a spray header 92' including a plurality of charge injectors 300, disposed therein parallel to the axis of rotation of drum 20. Spray headers 92, 92' are supplied with propane-diluted waxy oil from pipe 211. The spray headers 92, 92' include perforations or orifices which are uniformly spaced-apart along the length of each spray header and spray or sprinkle the propane-diluted hazy lube oil supplied by line 211 onto the wax cake formed on the drum as hereinafter described. The small pressure reduction produced by spraying the propane-diluted waxy oil through the orifices of the headers 92, 92' results in a small, further temperature reduction of typically 2°–3° C. It is, however, firstly remarked that unlike in conventional filter use when no charge injection is employed and waxy oil/solvent admixture is fed directly to the vat or trough, in the FIGS. 1 to 4 embodiment some of the charged waxy oil solvent sprayed onto the filter drum, instead of being drawn through the wax cake on the drum as described in detail below, streams down the wax cake and drips into the filter trough 10 while filtrate is drawn through the filter cloth under vacuum from the chilled slurry in the trough. Alternatively or in addition to part of the sprayed waxy oil/solvent streaming down the filter cake, a part feed (with or without oil solvent) of the hazy lube which is uncharged can be fed directly into the vat 10. A level controller (not shown) may be added to control the level of slurry in vat 10, for example by means of a flow regulating valve in the feed line 21 to the spray header 92' of each rotary drum filter 213.

Filter drum 20 is of a generally overall cylindrical shape having a diameter slightly less than that of the diameter of vat 10, such that drum 20 is rotatable about its axis in vat 10 on a pair of trunnions 22. One of the pair of trunnions 22 has a plurality of holes therein, each of which communicates with conduit means such as fluid conduits 30 and 31 and with trunnion valve means 24 to perform varying operations during each revolution of drum 20 as described hereinafter. The other trunnion communicates with a conventional drum rotation means (not shown) to rotate drum 20 in vat 10. Each conduit 30 and 31 extends along substantially the entire axial length of drum 20. A series of uniformly spaced channel sections 40 extend outwardly from the curvilinear surface of drum 20 parallel to the axis of rotation. Terminal sections 42 disposed near the ends of drum 20 connect each section 40 to an adjacent channel section, to thereby define a series of segments 44 circumferentially disposed around drum 20. Each segment 44 has two series of circumferential openings through drum 20 evenly spaced along substantially the entire axial length of each segment to form circumferential rows with one series of openings 32 in general alignment with fluid conduit 30 and with the other series of openings 34 in general alignment with fluid conduit 31. In each segment 44 the leading opening 32 in the direction of rotation hereinafter is referred to as the lead opening while the immediately adjacent trailing opening 34 is referred to as the lag opening.

A means for removing the filter cake from filter cloth 60 such as doctor knife 100 disposed in a compartment in vat 10 is shown which discharges the filter cake into a screw conveyor 102 which directs the filter cake out of vat 10 through outlet 104.

Within each segment 44 is disposed a filter grid 50 to maintain filter cloth 60 spaced apart from drum 20. Filter cloth 60 is stretched over channel sections 40 and grids 50 and is retained in position by a caulking bar (not shown) compressingly inserted in channel section 40 and by circumferential wires (not shown). A baffle (also not shown) may be disposed between grid 50 and filter cloth 60 in substantial alignment with at least one circumferential opening. It has been found that the liquid remaining in conduit 31 tends to be blown to the ends of the conduit when gas is passed outwardly through conduit 31, while flow to conduit 30 is blocked by means of trunnion valve 24. Accordingly, baffles preferably should be located in substantial alignment with at least certain of the circumferential openings 31 at the ends of drum 20 to decrease the erosive effects of the liquid on filter cloth 60. The baffles form no part of the present invention but further details are disclosed in U.S. Pat. No. 4,309,288 (Ryan et al.) assigned to the present assignees, the contents of which are incorporated herein by reference.

Figure 4:
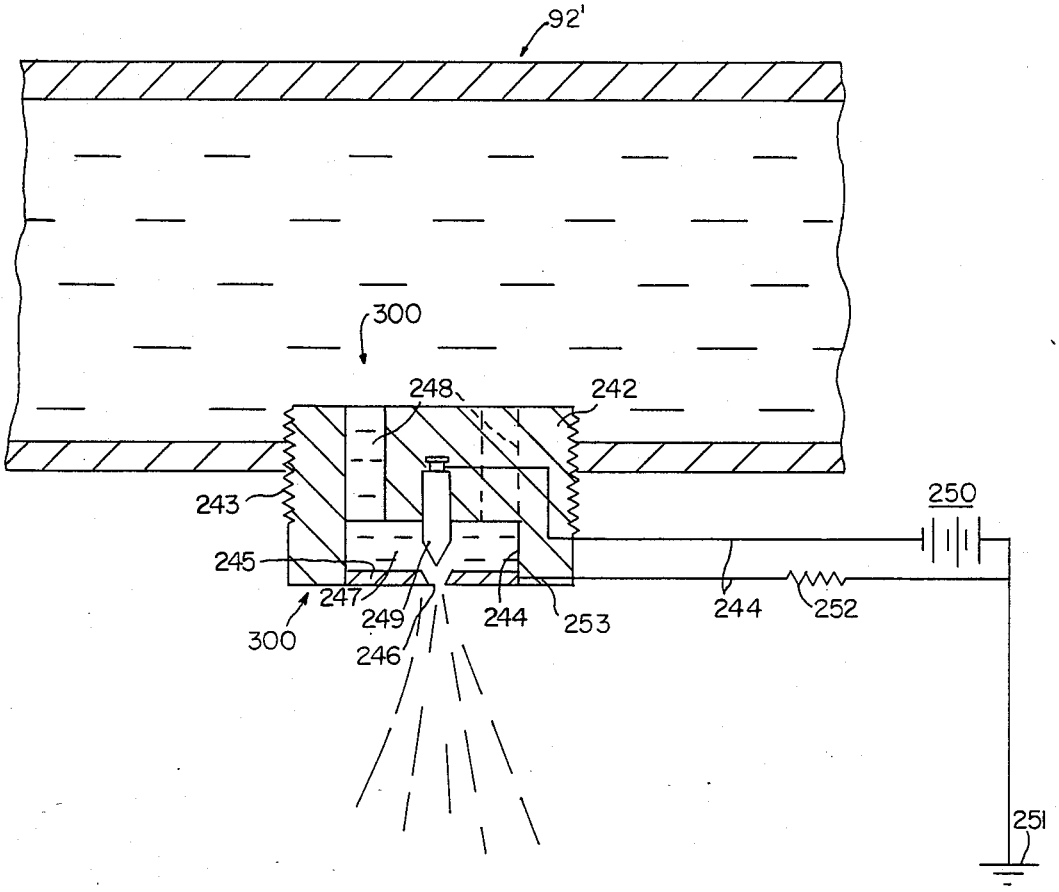
FIG. 4 is a longitudinal sectional view through a part of the spray header or drip pipe showing in more detail the construction of each charge injector.

A typical filter for the separation of wax from lube oil has a filter drum 20 thirty feet in length and eleven and one-half feet in diameter This drum has an effective filtering area of approximately 1000 square feet with 720 two-inch diameter circumferential openings 32, 34 disposed about the drum substantially as shown in FIG. 4. It is sufficient for the drum 20 to rotate comparatively slowly, e.g. in the range 0.1 to 5 rpm.

Figure 2:
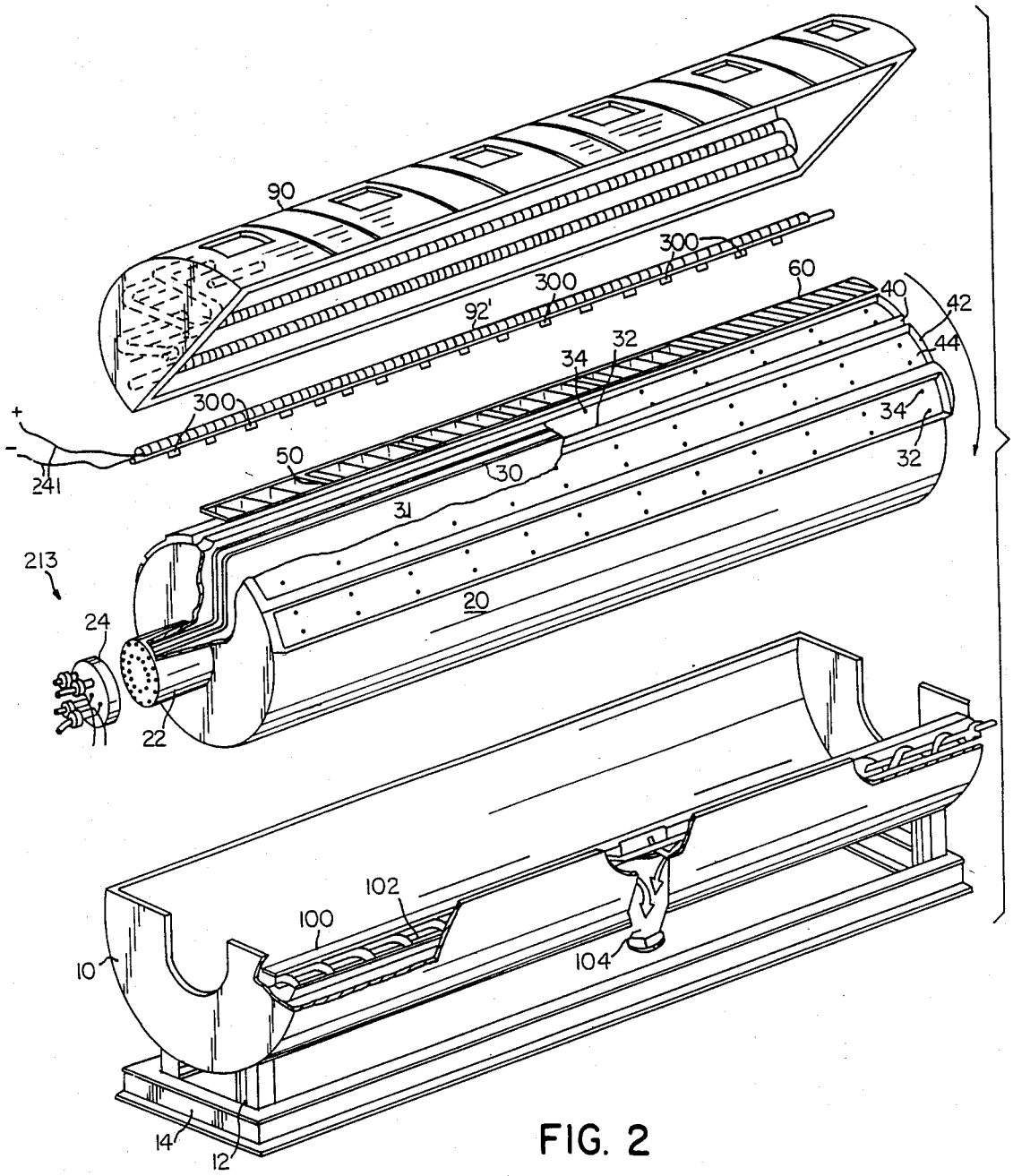
FIG. 2 is an exploded perspective view of one of the rotary drum filters employed in the filtration stage, in which the spray header includes a plurality of charge injectors.
Figure 3:
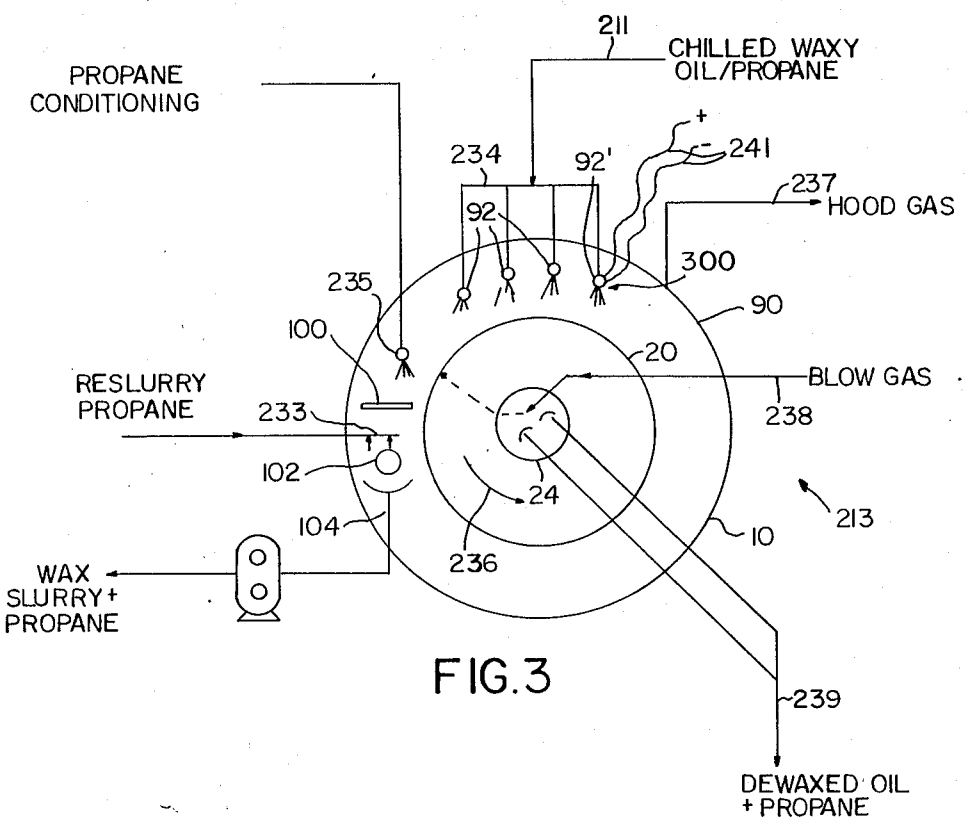
FIG. 3 is a diagrammatic view of the rotary drum filter in end elevation (viewed from the far end (drive end) of the filter shown in FIG. 2) indicating how various lines are connected to the filter unit.

FIG. 2 illustrates the main components of each rotary drum filter 213. However, certain other details are omitted from FIG. 2 for clarity but are shown in FIG. 3, to which reference is now made. In addition to the components already described, the rotary drum filter 213 includes a reslurry propane spray manifold 233, positioned above the screw conveyor 102, which sprays cold liquid propane onto the wax scraped from the filter cloth 60 by the doctor knife 100 so as to "reslurry" the wax to facilitate conveying that wax from the filter 213 to the wax solvent recovery facilities (not shown) of the plant. As shown, the rotary drum filter includes three circumferentially spaced-apart spray headers 92, and also one spray header 92' with charge injectors 300, which extend parallel to the drum axis and are fed with chilled waxy oil from a common manifold 234 supplied from line 211. Electrical power supply leads for the charge injectors 300 are indicated at 241 in FIG. 2. It is remarked that it is sufficient to include charge injectors in the one spray header 92', because the injected charge will be distributed throughout the chilled out-of-specification waxy oil on the wax cake on the filter drum where the sprayed waxy oil from the several spray headers 92 becomes mixed with the sprayed waxy oil from the leading spray header 92'. In addition, it is not essential that it be the leading spray header which includes the charge injectors. They could be incorporated in one (or more) of the other spray headers instead. The spray header 92' is arranged in the leading position, relative to the three headers 92, having regard to the direction of drum rotation which is indicated by arrow 236 in FIG. 3. The headers 92, 92' all extend parallel to the drum axis.

A further spray header or drip pipe 235, which also extends, inside hood 90, parallel to the drum axis, is located in a lag position relative to the four spray headers or drip pipes 92 and is used for spraying conditioning propane onto the filter drum. Gas (mainly propane vapor) inside the filter hood 90 is removed along line 237. As will be explained in more detail hereinbelow, purge and "blow" gas can be introduced into the drum filter 213 along line 238 and through trunnion valve 24.

With reference now to the detailed longitudinal sectional view through one of the charge injectors 300 as shown in FIG. 4, the charge injector is mounted in an opening in the underside of the spray header. This opening is internally screwthreaded for normally receiving an externally screwthreaded nozzle containing a spray orifice, this being the preferred constructional arrangement for spray headers 92. In this way spray header 92' is a simple adaptation of spray header 92 in which the spray nozzles are unscrewed and charge injectors are inserted in their place. The charge injector comprises a body 242 of cylindrical shape formed with an externally screwthreaded portion 243 which is interengaged with the internal screwthread of the opening in the header wall underside. The body 2 comprises a cylindrical block of electrically insulative material in which a blind cylindrical recess 244 is formed in the lower region. The charge injector includes a bottom wall 245 in the form of a circular electrically conductive plate, with a central opening 246, which closes off the blind recess at the bottom to define an enclosed space or chamber 247 within charge injector body 242. This enclosed space communicates by means of a plurality of axial passageways 248, drilled in cylindrical block 242, with the inside of header 92'. A pointed high potential electrode 249 is embedded in the material of the charge injector body 242 and arranged with its pointed tip projecting into enclosed chamber 247 in alignment with orifice 246 in electrode plate 245 and terminating a short distance from the electrode plate. The electrical supply leads 241 are respectively connected to conductor buses 253 which are embedded in the material of the charge injector body and are connected at one end to the pointed, high potential, electrode 249 and to the electrode plate 245, respectively, and project at their other ends through the side wall of the charge injector body 242 where they are respectively connected, by the supply leads 241, to the negative terminal of a high voltage power supply 250, whose positive terminal is connected to earth 251, and directly to earth 251 through a resistance element 252. The charge injector 300 has been briefly described above but further details may be ascertained by referring to the aforesaid Kelly U.S. Pat. No. 4,255,777.

In operation, chilled oil/propane admixture in header 92' enters the charge injectors 300 through the axial passageways 248. In each charge injector the chilled oil/propane admixture flows from the axial passageways 248 into the enclosed chamber 247 and exits the charge injector through orifice 246. Free excess electric charge which is net unipolar is injected from the pointed tip of electrode 249, by the electrode pair 245, 249, into the propane-diluted oil which issues through the orifice 246 and streams or sprays through the vapor space inside the rotary drum filter hood 90, onto the wax cake on the filter drum. The vapor space is important in helping to minimise dissipation of charge from the wax cake back to the charge injectors, which if allowed to occur would reduce the effectiveness of the filter in collecting and separating wax from the chilled propane-diluted waxy oil. The injected charge is volumetrically distributed within the propane-diluted lube oil and is thereby transferred to the dispersed wax particles in the propane-diluted oil sprayed onto the wax cake by the headers 92, 92'. The charge promotes collection of wax haze on the already formed wax cake on the filter drum.

The varying operations performed simultaneously by a typical rotary filter such as that of FIG. 2 will now be described with particular reference to FIG. 3. When a point on filter cloth 60 is in a position included within the bottommost sector (sector "A") which corresponds with the drum portion which is submerged in the cold propane diluted oil and wax and ice crystals in the filter trough, that point is at reduced pressure relative to the pressure in the vapor space inside the filter hood. Filtrate is drawn through filter cloth 60, circumferential openings 32 and 34 and fluid conduits 30 and 31, respectively, and flows along line 239. The solid wax and ice crystals are retained on filter cloth 60 and build up to form a wax filter cake. As the point on filter cloth 60 continues to rotate, that point rises out of the slurry (into sector "B"). Suction continues to be applied to continue to draw any further filtrate through circumferential openings 32 and 34 and fluid conduits 30 and 31, respectively, thereby further drying the filter cake.

When the point rotates still further to a position within a sector (sector "C") including the spray headers 92, 92', chilled, charged and uncharged, propane-diluted waxy oil is sprayed or sprinkled onto the filter cake while suction continues to be applied. Wax and ice crystals in the sprayed oil/propane admixture are retained on the wax cake, while the resulting haze-free DWO and propane are withdrawn along conduits 30, 31.

It is remarked that even relatively fine wax and ice crystals in the chilled hazy lube oil/solvent sprayed onto the filter drum are separated more effectively on the already-formed, cold, wax cake on the filter cloth than if they were to be collected directly on the filter cloth of the rotary drum filter such as in sector "A", the filter cloth being a less effective collector than the already formed wax cake itself.

When the point on filter cloth 60 rotates still further (sector "D"), valve means 24 continues evacuation of fluid conduits 30 and 31 while a conditioning fluid (such as propane) is sprayed through spray header 235 in filter hood 90 to wash filtrate from the wax cake and also to harden up the cake so as to facilitate discharging the cake from the filter cloth by blow gas. The conditioning propane passes through the wax cake, filter cloth 60, circumferential openings 32, 34 and fluid conduits 30, 31, respectively for removal from the filter.

When the point on filter cloth 60 rotates to a position in a sector (sector "E") between spray header 235 and doctor knife 100, the filter cake is again dried by discontinuing external conditioning flow and continuing to apply suction to the sector which pulls conditioning propane from the wax cake through circumferential openings 32, 34, and fluid conduits 30, 31, respectively.

As the point rotates still further to a sector (sector "F") between the sector "E" and doctor knife 100, purge gas, typically having a velocity of about 100 feet/second, is supplied to fluid conduit 31 communicating with lag opening 34 while the immediate adjacent lead opening 32 continues to be maintained under suction. This serves to cause some of the liquid remaining in fluid conduit 31 communicating with lag opening 34 to flow into fluid conduit 30 communicating with lead opening 32.

As the point rotates still further (into sector "F")but still before reaching the position of the doctor knife 100), lead opening 32 is no longer evacuated. The purge gas, which is called blow gas at this point, plus any remaining liquid in fluid conduit 31 communicating with lag opening 34 is discharged against an above-mentioned baffle and, after deflection, contacts filter cloth 60, causing the cloth to billow out slightly, thereby facilitating the subsequent removal of the cake by doctor knife 100. It should be noted if baffles were not installed in the subject filter, liquid remaining in conduits 30 would be conveyed by the high velocity purge gas against filter cloth 60 causing the cloth to erode, particularly at the ends of drum 20 where the liquid tends to collect.

With regard to the relative sizes of the sectors described, it is to be understood that the length of time that any given point on filter cloth 60 spends in a particular sector may be adjusted by varying the size of the sector and by varying the rate of rotation of drum 20.

It is remarked that in FIG. 1 only the major items of the filtration stage 200 have been shown for simplicity. As in the case of the chilling and dilution stage 210 specifically described, the filtration stage comprising a pair of rotary drum filters 213 is well known in the art and therefore details of less important pipe connections, control valve arrangements etc. have been omitted from FIG. 1 for clarity.

From the foregoing description of FIGS. 1 to 4 it will be appreciated that a number of principal advantages are obtained with the filter described. Firstly, the cold wax cake already formed on the filter cloth of each rotary drum filter 213 represents a more-effective collector of the fine wax and ice crystals contained in the sprayed propane-diluted chilled hazy oil from the filter feed drum 212 than would be the case if that hazy oil were to have been introduced directly into the filter vat of each rotary drum filter 213. Secondly, the use of charge injection enhances recovery of wax from the hazy lube oil and prevents or minimises fines breakthrough. Thirdly, the dilution and chilling stage 200, the filtration stage 201, propane recovery stage 202 and storage tanks 203 collectively form a standard known batch chilling dewaxing plant and the embodiment of FIGS. 1 to 4 merely represents a simple addition to this known plant in the form of the charge injectors 300, together with the necessary line interconnections/-modifications including that for supplying the propane-diluted, wax-bearing lube oil from the dilution and chilling stage 200 to the headers 92, 92' rather than directly into the filter vat 10. The cost of installing and operating the extra equipment is relatively small and it does not necessitate installing an entirely new plant.

Figure 5:
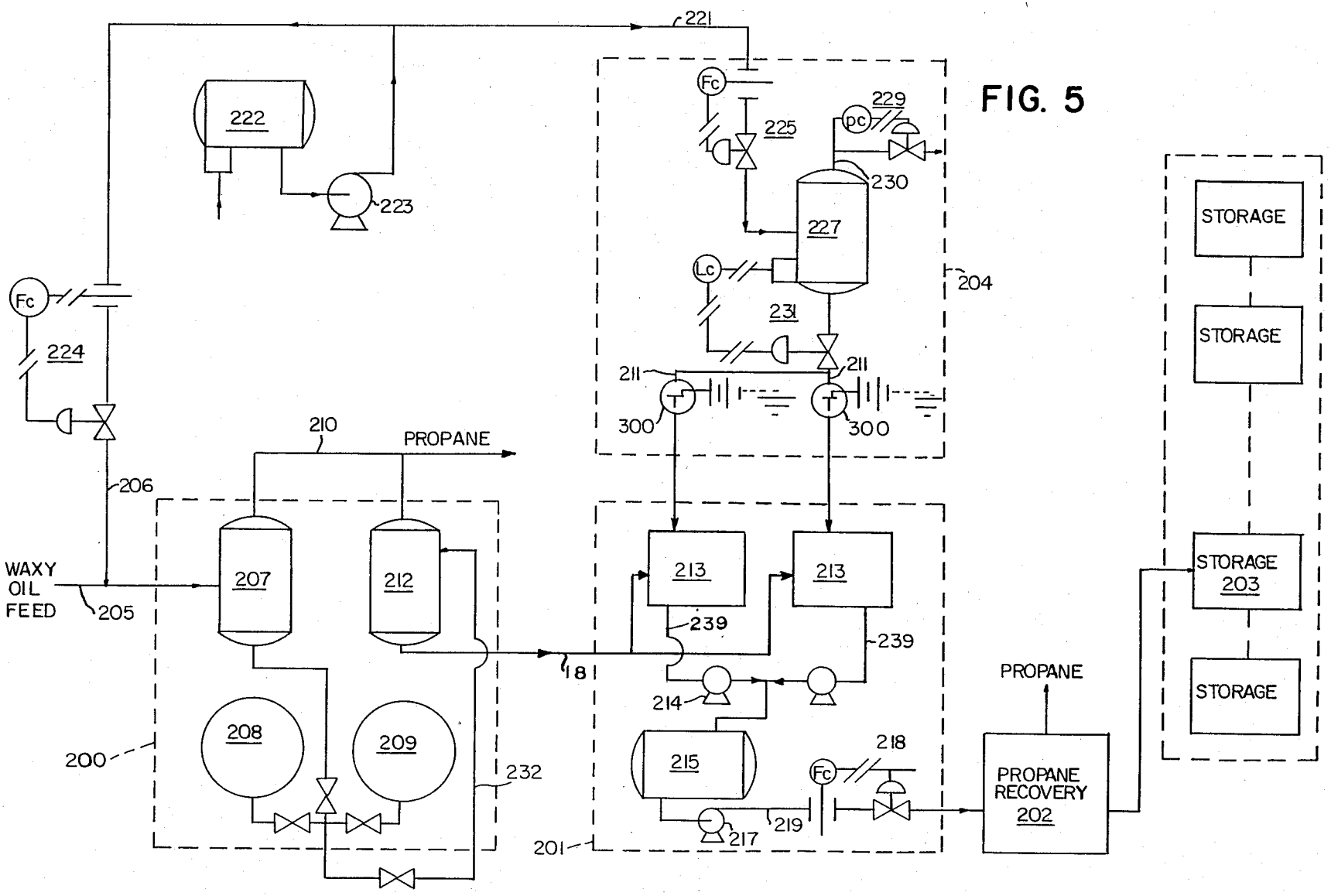
FIGS. 5, 6 and 7 are views corresponding with FIGS. 1, 2 and 3, respectively, of a second embodiment.
Figure 6:
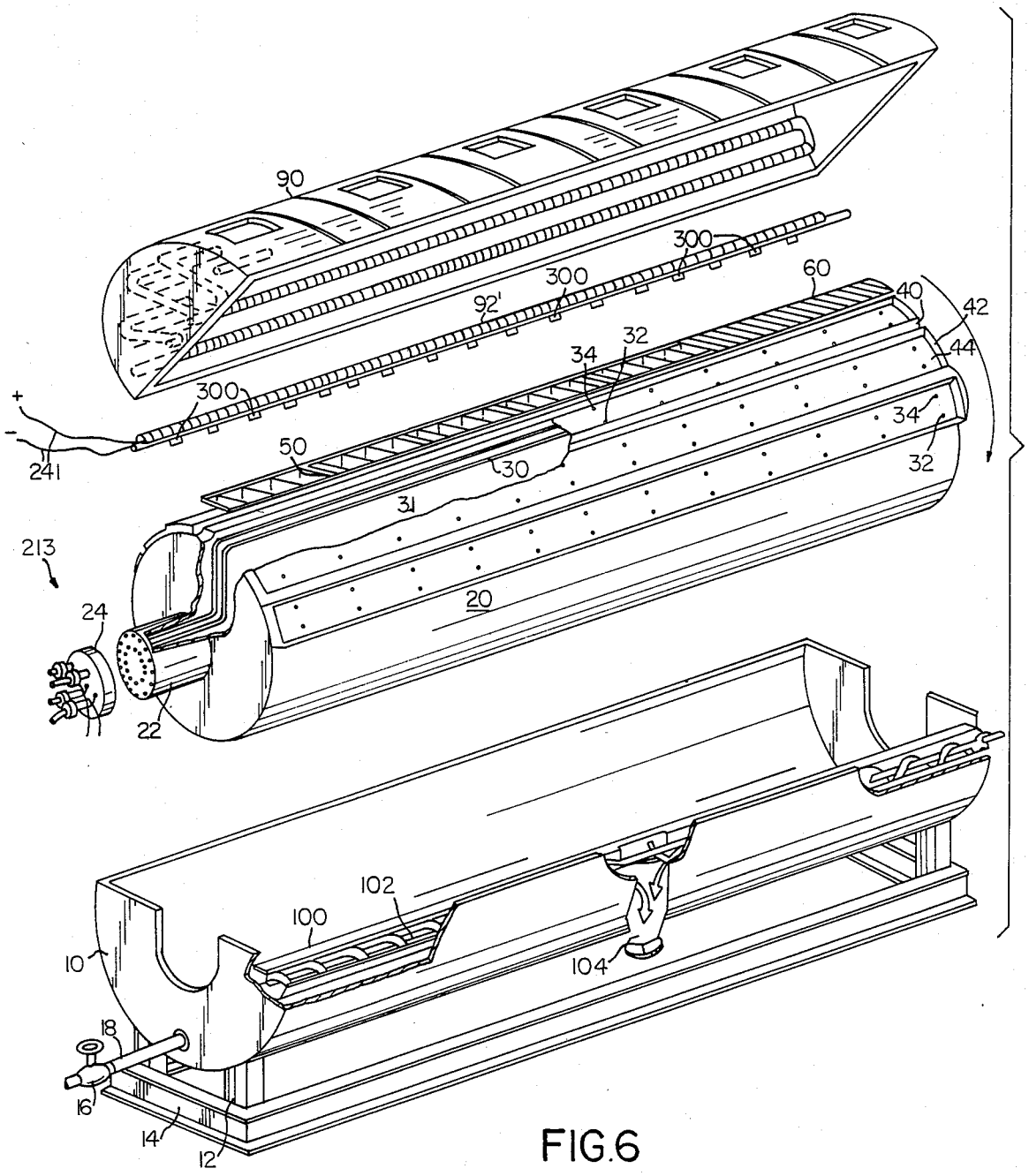
Figure 7:
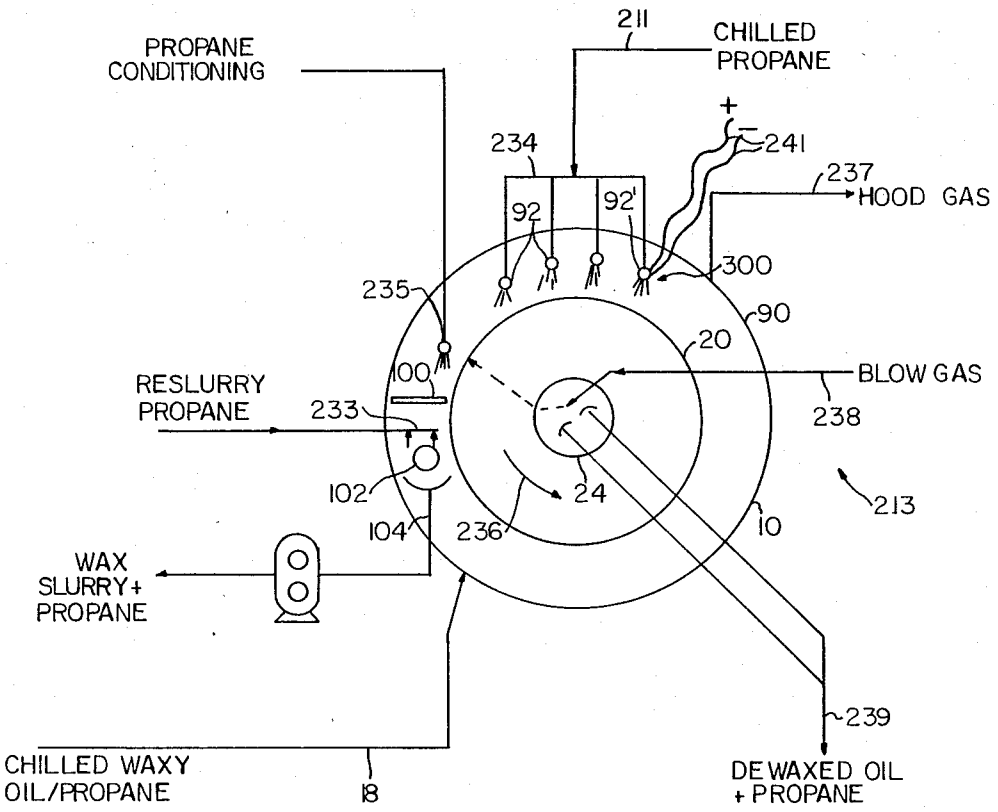

Referring now to the embodiment of FIGS. 5 to 7, this is essentially the same as in FIGS. 1 to 4, except that the chilled, propane-diluted, waxy oil from filter feed drum 212 is fed directly into the filter vat 10 (as in a conventional filter) of each rotary drum filter and the wax cake on each filter drum is sprayed with chilled, charged, propane solvent. As shown in FIG. 5, some of the liquid propane delivered by pump 223 is branched off along line 221 and fed into flash drum 227 at a controlled flow rate determined by flow control valve arrangement 225. Flashing of the propane occurs at high pressure across valve 225 and in drum 227, to chill the remaining propane (producing a temperature reduction typically of 20°-30° C.) which is then delivered to the rotary drum filters 213 of the filtration stage 201. The flash drum pressure is controlled at about 2 atmospheres by a pressure regulating arrangement 229 in a propane vapor vent line 230 leading from the flash drum 227, and the liquid level in the flash drum is regulated by a level control arrangement 231. The chilled propane from the flash drum is delivered along line 211 to the charge injectors 300 in the spray headers 92' and to the spray headers 92.

As shown in FIG. 6, line 18 from the filter feed drum communicates with the filter vat 10 at one end and any level controller used to control the slurry level in vat 10 achieves that control by regulating valve 16 in line 18.

Operation of the rotary drum filter is essentially the same as that described above with reference to FIG. 3. The proportion of sprayed charged propane which streams down the wax cake on the rotating drum and drips into the filter vat 10 serves as a charge carrier fluid which imparts charge to the wax cake and, in the filter vat, transfers charge to the dispersed phase present, i.e. wax, ice crystals, water droplets and other fines In this way, the efficiency of haze separation is enhanced.

Figure 8:
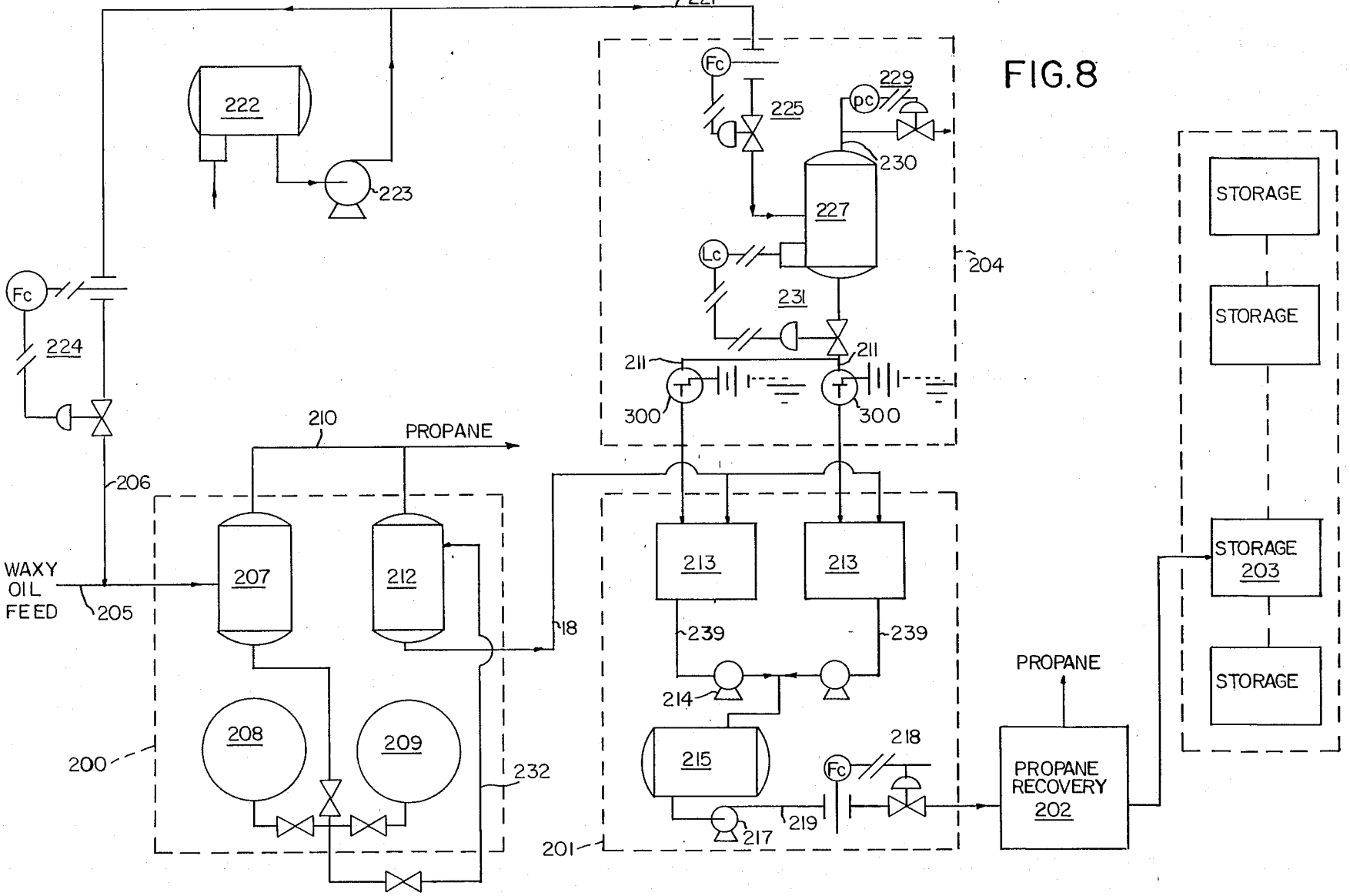
FIGS. 8 and 9 are views corresponding with FIGS. 1 and 3, respectively, of a third embodiment.
Figure 9:
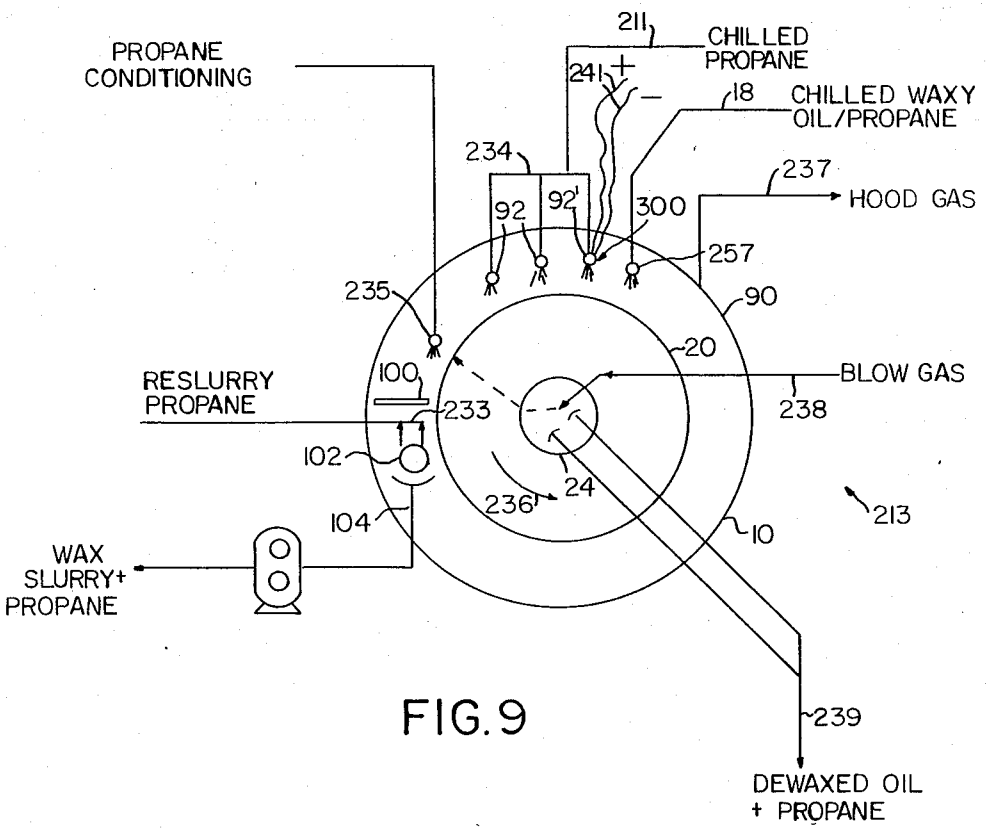

Referring now to the embodiment of FIGS. 8 and 9, the filter feed drum contents are sprayed onto each filter feed drum just prior to washing the filter cake with charge propane solvent In this embodiment, the drum filter construction is the same as that shown in FIG. 2 but only three headers 92, 92' are shown, supplied with chilled propane. The number of headers supplied by manifold 234 is of no particular significance, as is also the case in the embodiment of FIGS. 1 to 4. A further header 257 arranged in sector "C" in a leading position relative to lead header 92' is connected to be fed from line 18 so that header 257 sprays uncharged chilled waxy oil/solvent onto the filter drum.

Operation of each rotary drum filter is again very similar to that described with reference to FIGS. 1 to 4. Charged chilled propane and waxy oil dripping off the drum surface into the filter trough impart charge to the propane/waxy oil slurry in the trough 10 and the effect of the charged wax cake and the charge in the trough promotes the collection of wax and ice crystals on the filter drums.

Figure 10:
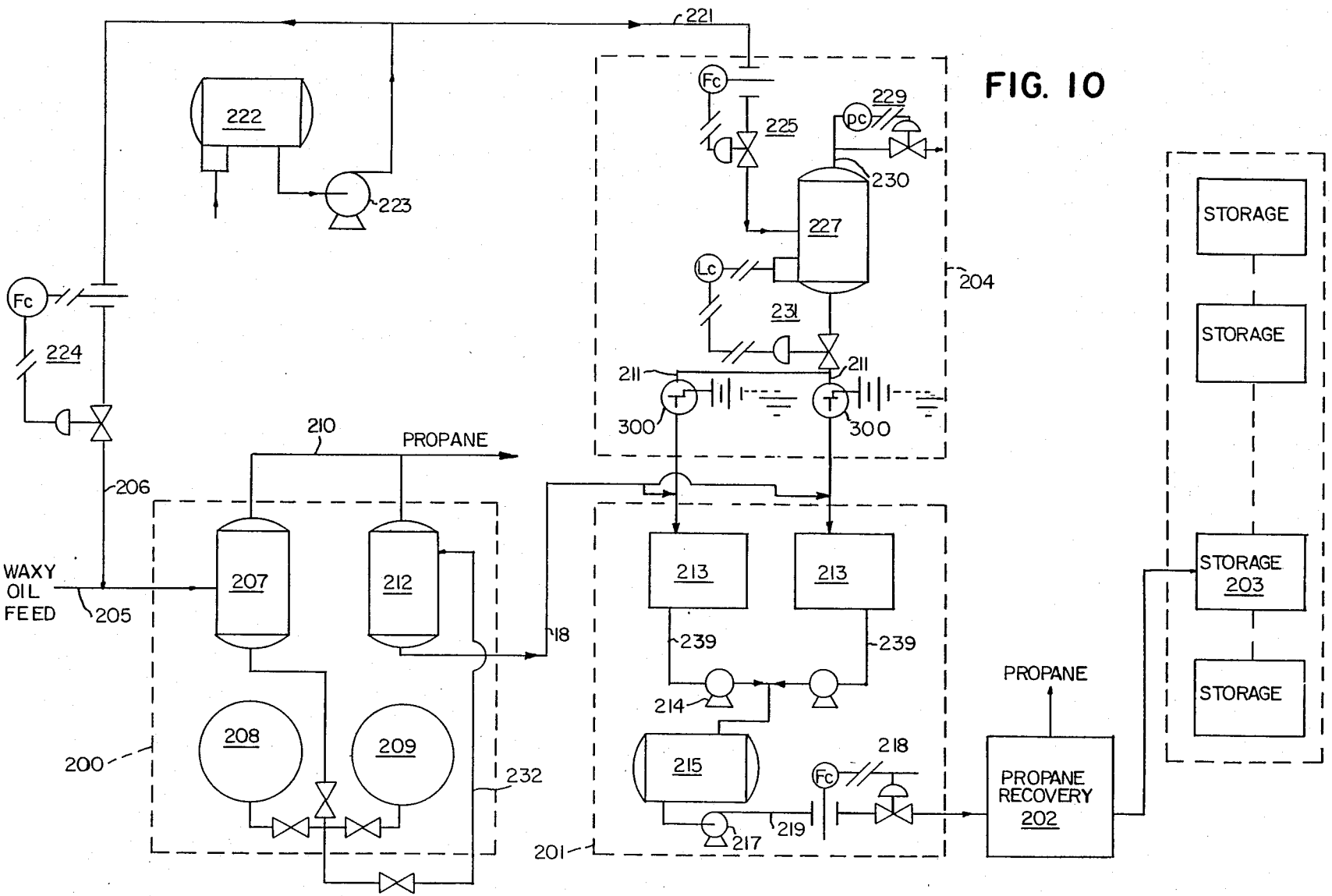
FIG. 10 is a modification to FIG. 8.
Figure 11:
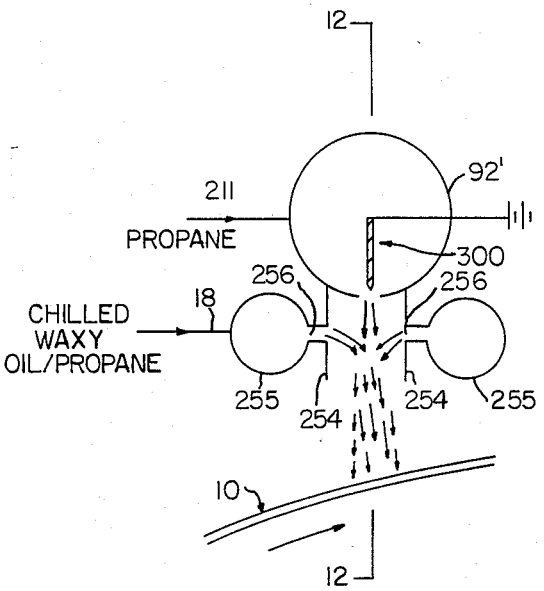
FIG. 11 is a cross-sectional view through a modified spray header employed in the FIG. 10 embodiment.
Figure 12:
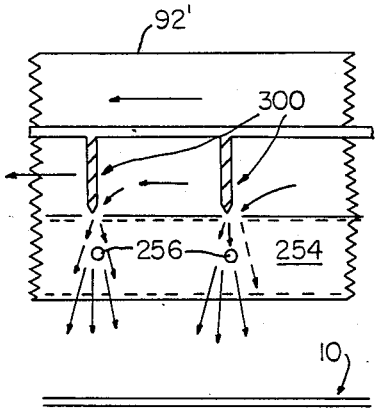
FIG. 12 is a sectional view taken along the section line XII—XII of FIG. 11.

A modification to the embodiment of FIGS. 8 and 9 is shown in FIGS. 10 to 12, in which charge is injected, by charge injectors 300, into the chilled liquid propane from the flash drum 227 and the charged propane streams or sprays downwardly through the spray orifices in the underside of the spray header 92'. Two downwardly projecting guide plates 254 are secured to the underside of spray header 92' and extend over substantially the whole length of the spray header. These guide plates are respectively arranged so as to be positioned one at each side of the several sprays of charged propane produced by the charge injectors. Two distributor pipes 255, extending alongside the guide plates 254, are fed with the waxy oil/propane from the one line 18 and communicate, through spray openings 256 disposed at the same axial locations as the charge injector orifices, with the space between the guide plates 254 so that waxy oil/propane is sprayed through these openings 256 and becomes entrained by and intimately mixed with the charged propane spray from each charge injector 300. The several such combined sprays impinge upon the wax cake on the rotating filter drum and the combined effects of the injected charge and the chilled liquid propane cause the formation of wax and ice crystals which are collected on the wax cake.

It is to be understood that the foregoing disclosure and description are only illustrative and explanatory of the invention. Various changes in and modifications to the components of the inventive apparatus and methods, as well as in the details of the illustrated apparatus and of the disclosed processes, may be made within the scope of the appended claims without departing from the spirit of the invention. For example, the flash drum 227, in the FIGS. 5 to 12 embodiments can be replaced by a control valve across which the liquid propane is flashed to produce the required chilling. Furthermore, in some instances it may be possible to dispense with the flash drum (or any other propane chilling means) altogether, providing the temperature of the cold wax cake is low enough to produce adequate crystallisation and separation of wax from the waxy lube oil and propane in the rotary drum filters. In that case, the propane serves principally purely as a diluent and oil solvent, and as a carrier of charge. According to another development of the FIGS. 5 to 12 embodiments, a proportion of the DWO/propane in line 219 is branched-off, chilled close to the filtration temperature, and recycled to the charging stage 204 so that charge is injected into the chilled recycled DWO/propane. Surge drum 222 and pump 223 are then not used to pump propane along line 221.

It is also pointed out that propane is a preferred oil solvent but reference to it is not to be construed as implying that propane is the only solvent which could be used. Other oil solvents, e.g. a ketone, which act as auto-refrigerants are well known in the art and can be used instead Furthermore, the invention is not to be regarded as confined to the particular form of dilution and chilling stage disclosed herein, i.e. batch chillers. For example, in ketone dewaxing the waxy oil feed typically is chilled continuously to the desired filtration temperature in a series of double pipe "scraped surface" exchangers and chillers used in place of the batch chillers disclosed hereinabove.

What is claimed is:

1. A method of removing wax from a hazy hydrocarbon oil mixture boiling in the lubricating oil range using a rotary drum filter, said filter comprising a filter vat for containing a quantity of oil solvent-diluted hazy oil mixture and a rotatable drum in the vat having a horizontal axis of rotation and also having filter cloth thereon, said method comprising the steps of:

introducing oil solvent-diluted hazy oil mixture into said filter vat to a depth such that, at any instant, a sector of the drum surface is immersed in the oil solvent-diluted hazy oil mixture in said filter vat;

rotating the drum;

applying suction to the rotating filter drum over the immersed sector thereof, so as to draw filtrate through the filter cloth and form a wax cake on said cloth;

removing a portion of the wax cake from the filter cloth on the rotating filter drum in a further sector;

introducing free charge which is net unitpolar into a charge carrier liquid, at least predominantly by electron emission which causes the carrier liquid to act as a medium through which volumetric distribution of the introduced charge takes place by charge motion relative to the carrier liquid; and directing the charged liquid onto the wax cake, there being a sufficient excess of free charge introduced as to promote removal of wax in the rotary drum filter.

2. A method as claimed in claim 1, wherein said charge carrier fluid is oil solvent-diluted hazy oil mixture.

3. A method as claimed in claim 1, wherein said charge carrier liquid is an oil solvent liquid.

4. A method as claimed in claim 3, wherein said charge carrier liquid is an oil solvent liquid which is sprayed onto the wax cake and wherein uncharged, oil solvent-diluted waxy oil mixture is sprayed onto the drum surface in a leading position, relative to the sprayed charged oil solvent liquid, having regard to the rotational sense of the drum of the rotary filter.

5. A method as claimed in claim 3, wherein said charge carrier liquid is an oil solvent liquid which is sprayed onto the wax cake and wherein uncharged, oil solvent-diluted, waxy oil mixture is sprayed into the sprayed charged oil solvent liquid so as to become intimately mixed with an entrained by the sprayed charged oil solvent liquid before that liquid reaches the wax cake on the filter drum.

6. A method as claimed in claim 1, wherein the charge carrier liquid is a recycled proportion of the dewaxed oil solvent-diluted oil mixture produced by the rotary drum filter.

7. A method as claimed in claim 1, wherein said oil solvent-diluted hazy oil mixture in said filter vat is pre-chilled to promote wax crystallization.

8. A method as claimed in claim 7, wherein said oil solvent in said waxy oil mixture is an auto-refrigerant liquid which is partially vaporized so as to pre-chill the oil solvent-diluted hazy oil mixture.

9. A method as claimed in claim 1, wherein said charge carrier liquid is an oil solvent liquid which is pre-chilled, so as to promote wax crystallization following contact with said oil solvent-diluted waxy oil mixture in said filter vat.

10. A method as claimed in claim 9, wherein said charge carrier liquid is an auto-refrigerant oil solvent liquid which is partially vaporized before being directed onto the wax cake, so as to pre-chill said oil solvent liquid.

11. A method as claimed in claim 1, wherein the free charge is introduced by flowing a stream of the carrier liquid past a pointed high potential electrode at sufficient velocity that free charge is injected by field emission into the carrier liquid and is conveyed by the flowing stream away from the high potential electrode.

12. A method as claimed in claim 1, wherein the free charge is introduced without producing ionic dissociation within the carrier liquid.

13. A method as claimed in claim 1, wherein said carrier liquid is introduced into a spray header and sprayed from a plurality of orifices in the header, the header extending substantially parallel to the axis of the drum of the rotary filter and the orifices being evenly spaced along the length of the header, and wherein free charge that is net unipolar is introduced into the carrier liquid immediately prior to being sprayed through each orifice.

14. A method as claimed in claim 13, wherein the free charge is injected by field emission into the carrier liquid.

15. A method as claimed in claim 13, wherein further carrier liquid from the same source is introduced into a further spray header and, without being charged, is sprayed from a plurality of orifices in the further header, said further header extending substantially parallel to the axis of the drum of the rotary filter and the orifices in said further header being evenly spaced along the length thereof.

16. A method of removing wax from a hazy hydrocarbon oil mixture boiling in the lubricating oil range using a rotary drum filter, said filter comprising a filter vat containing a quantity of oil solvent-diluted hazy oil mixture and a rotating drum in the vat, having a horizontal axis of rotation and also having filter cloth thereon so that, at any instant, a sector of the drum surface is immersed in the oil solvent-diluted hazy oil mixture in said filter vat, wherein, starting from a point on the rotating filter cloth entering the oil solvent-diluted hazy oil mixture in the filter vat, that point is subjected, in successive sectors through which it passes in turn, to the respective steps of:

having suction applied so as to draw filtrate through the filter cloth while forming a wax cake on the filter cloth;

spraying solvent-diluted hazy oil mixture, into which free charge which is net unipolar has been injected by field emission, onto the wax cake, said field emission causing the charge-injected, solvent-diluted, hazy oil mixture to act as a medium through which volumetric distribution of the introduced charge takes place by charge motion relative to the charge-injected, solvent diluted, hazy oil mixture;

spraying a conditioned oil solvent liquid onto the wax cake to remove filtrate from the wax cake;

directing blow gas onto the filter cloth to cause it to billow out slightly; and scraping the wax cake from the filter cloth before said point re-enters the oil solvent-diluted hazy oil mixture in the filter vat.

17. A method of removing wax from a hazy hydrocarbon oil mixture boiling in the lubricating oil range using a rotary drum filter, said filter comprising a filter vat containing a quantity of oil solvent-diluted hazy oil mixture and a rotating drum in the vat, having a horizontal axis of rotation and also having filter cloth thereon so that, at any instant, a sector of the drum surface is immersed in the oil solvent-diluted hazy oil mixture in said filter vat, wherein, starting from a point on the rotating filter cloth entering the oil solvent-diluted hazy oil mixture in the filter vat, that point is subjected, in successive sectors through which it passes in turn, to the respective steps of:

having suction applied so as to draw filtrate through the filter cloth while forming a wax cake on the filter cloth, while replenishing oil solvent-diluted hazy oil mixture is introduced directly into the filter vat;

spraying oil solvent liquid, into which free charge which is net unipolar has been injected by field emission, onto the wax cake, said field emission causing the charge-injected, oil solvent liquid to act as a medium through which volumetric distribution of the introduced charge takes place by charge motion relative to the charge-injected oil solvent liquid;

spraying a conditioning oil solvent liquid onto the wax cake to remove filtrate from the wax cake;

directing blow gas onto the filter cloth to cause it to billow out slightly; and scraping the wax cake from the filter cloth before said point re-enters the oil solvent-diluted hazy oil mixture in the filter vat.

18. A method of removing wax from a hazy hydrocarbon oil mixture boiling in the lubricating oil range using a rotary drum filter, said filter comprising a filter vat containing a quantity of oil solvent-diluted hazy oil mixture and a rotating drum in the vat, having a horizontal axis of rotation and also having filter cloth thereon so that, at any instant, a sector of the drum surface is immersed in the oil solvent-diluted hazy oil mixture in said filter vat, wherein, starting from a point on the rotating filter cloth entering the oil solvent-diluted hazy oil mixture in the filter vat, that point is subjected, in successive sectors through which it passes in turn, to the respective steps of:

having suction applied so as to draw filtrate through the filter cloth while forming a wax cake on the filter cloth;

spraying uncharged solvent-diluted hazy oil mixture onto the wax cake;

spraying an oil solvent liquid, into which free charge which is net unipolar has been injected by field emission, onto the wax cake, said field emission causing the charge-injected oil solvent liquid to act as a medium through which volumetric distribution of the introduced charge takes place by charge motion relative to the charge-injected oil solvent liquid;

spraying a conditioned oil solvent liquid onto the wax cake to remove filtrate from the wax cake;

directing blow gas onto the filter cloth to cause it to billow out slightly; and scraping the wax cake from the filter cloth before said point re-enters the oil solvent-diluted hazy oil mixture in the filter vat.

* * * * *